United States Patent [19]

Bourgeois et al.

[11] Patent Number: 5,065,735

[45] Date of Patent: Nov. 19, 1991

[54] CONVERTIBLE BURNER APPARATUS

[75] Inventors: Norman R. Bourgeois; Bradley A. Robichaux, both of Kenner, La.

[73] Assignee: Metal Fusion, Inc., Kenner, La.

[21] Appl. No.: 577,895

[22] Filed: Sep. 5, 1990

[51] Int. Cl.[5] ..... F24C 3/08

[52] U.S. Cl. ..... 126/40; 126/30; 126/9 R; 126/50

[58] Field of Search ..... 126/40, 24, 30, 9 R, 126/9 B, 50

[56] References Cited

U.S. PATENT DOCUMENTS

| | | | |
|---|---|---|---|
| 989,747 | 4/1911 | Yassenoff | 126/40 |
| 1,612,468 | 12/1926 | Reichold | 126/40 |
| 2,638,085 | 5/1953 | Guedon | 126/40 |
| 4,726,350 | 2/1988 | Steinhauser | 126/40 X |

FOREIGN PATENT DOCUMENTS

| | | | |
|---|---|---|---|
| 910865 | 6/1946 | France | 126/40 |

*Primary Examiner*—Larry Jones

*Attorney, Agent, or Firm*—Pravel, Gambrell, Hewitt, Kimball & Krieger

[57] ABSTRACT

A convertible burner apparatus includes a primary burner frame having upper and lower parallel rings connected by struts. A burner element is contained within the primary frame that can be connected to a source of fuel gas such as a canister of propane/butane. A plurality of radially spaced grate members are positioned adjacent the upper ring for supporting a pot thereupon during use. A plurality of legs are removably connectable to the primary burner frame for supporting the primary burner frame in an elevated position. Connections are provided for removably affixing each leg to the primary burner frame at positions adjacent the upper ring and at the middle portion of the leg and a plurality of spokes discourages lateral movement of the legs at a position below the lower ring.

9 Claims, 4 Drawing Sheets

CONVERTIBLE BURNER APPARATUS

BACKGROUND OF THE INVENTION

1. Field of the Invention

The present invention relates to an improved cooking apparatus using a burner fired with propane, butane or the like wherein a primary burner frame includes upper and lower parallel rings connected by struts and can be supported upon the bottom ring as a base in a lowermost cooking position for carrying very large pots, or alternatively in an elevated position for cooking in small pots such as when frying food in hot oil.

2. General Background

There are several commercially available cooking devices such as camp stoves, outdoor cookers, barbecue grills and the like which are fueled with a source of butane, propane or the like. This fuel is normally carried in a canister such as a disposable, commercially available canisters or in a five-ten (5–10) gallon permanent style canisters that can be refilled. Normally, such canisters are used with a regulator for controlling the pressure and flow rate of butane/propane from the canister.

Small cooking utensils such as camp stoves can be used on any type of surface because their weight is rather small and because they typically are used to hold very small cooking utensils and vessels such as small pots and skillets for example.

In the cooking of large amounts of seafood such as crabs, shrimp, crawfish, and the like very large pots are often used such as for example pots capable of containing one hundred (100) quarts of liquid. Pots of this size constitute a significant hazard when filled with fluid especially after this fluid has been heated to boiling temperatures of two hundred twelve (212) degrees °F. Typically, these large volume pots are used only when the burner is relatively short, such as for example twelve to eighteen (12–18) inches in overall height. Further, these shorter burners typically have a very broad base for preventing tipping.

When small quantities of food are to be fried in oil, a very small pot such as for example a five to ten (5–10) quart pot can be used rather than the eighty to one hundred (80–100) quart pots used for cooking large batches of shrimp, crabs and crawfish.

In the cooking of fried foods, small amounts of food are cooked at a time, and the turn over is usually fast. The food must be repeatedly added to and removed from the hot oil such as for example a new batch every four or five (4–5) minutes. Thus, it is desirable to elevate the burner apparatus to the approximate waist level so that a user is not required to continuously bend over during the cooking operation. However, this difference in cooking procedures usually dictates that the user buy two separate burners, including a smaller but structurally more desirable low level burner for cooking large volumes of seafood and a second burner for elevating the cooking vessel to a level of about thirty (30) inches above the ground for cooking fried seafood.

It has been common in the art to use outdoor cookers which are supplied by butane, propane and the like via a high pressure regulator, LP hose, and similar sources of fuel. Elevating such devices on legs in a permanent fashion has been done. It is an object of the present invention however to provide a convertible outdoor cooker apparatus that can be fired by butane, propane or the like as contained in canisters wherein removable legs can support the device in an elevated position such as on the order of thirty-thirty six inches (30"–36") above ground level if food is to be fried at an elevated position. The apparatus converts for use as a much more structural rigid base at a lower elevation when cooking in very large pots of the one hundred (100) quart capacity for example.

SUMMARY OF THE PRESENT INVENTION

The present invention thus provides an improved convertible burner apparatus. The apparatus includes a primary burner frame that includes upper and lower generally parallel rings and a plurality of struts connecting the rings and supporting the upper ring a distance above the lower ring.

The lower ring defines a base for bearing against a flat underlying surface during use. The burner element has an influent connection for removably connecting a source of fuel gas to the burner element. A plurality of radially spaced grate members are positioned adjacent the upper ring for supporting a pot during use.

A plurality of legs are removably connectable to the primary burner frames for supporting the primary burner frame in an elevated position wherein the legs each include feet for bearing against a flat underlying surface during use. A connection is provided for removably affixing each leg to the primary burner frame at positions respectively adjacent the upper ring and at the middle portion of the leg and means is provided for preventing lateral movement of the legs at a position below the lower ring.

In the preferred embodiment, a shroud is provided having a diameter smaller than the diameter of the upper ring for extending around the burner element.

In the preferred embodiment, the connection for removably affixing each leg to the primary burner frame includes an upper connector end portion of each leg that has a socket for receiving a portion of the primary burner frame. In the preferred embodiment the socket is generally U shaped.

In the preferred embodiment the legs have upper end portions and each socket is upwardly facing to receive the upper ring thereunto wherein each socket has a bottom portion receptive of the upper ring which bears upon each leg at the bottom of its socket.

In the preferred embodiment, each leg provides a bend at the middle portion thereof so that the upper portions of each leg are closer to the center of the primary burner frame than the lower portions of each leg during use.

In the preferred embodiment, each of the legs abuts the lower ring at the bend in the leg. In the preferred embodiment, the bend in each abuts the lower ring at an intersection between the lower ring and a strut of the primary burner.

In the preferred embodiment, there is further provided a nesting member adjacent the upper ring for laterally confining a pot and including grate members extending below the level of the upper ring and forming a connection with the nesting member. In the preferred embodiment, there is further provided a radially extending spoke connected to each leg at the lower end portion of the leg and a hub positioned inwardly of each leg and connected to each radially extending spoke.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
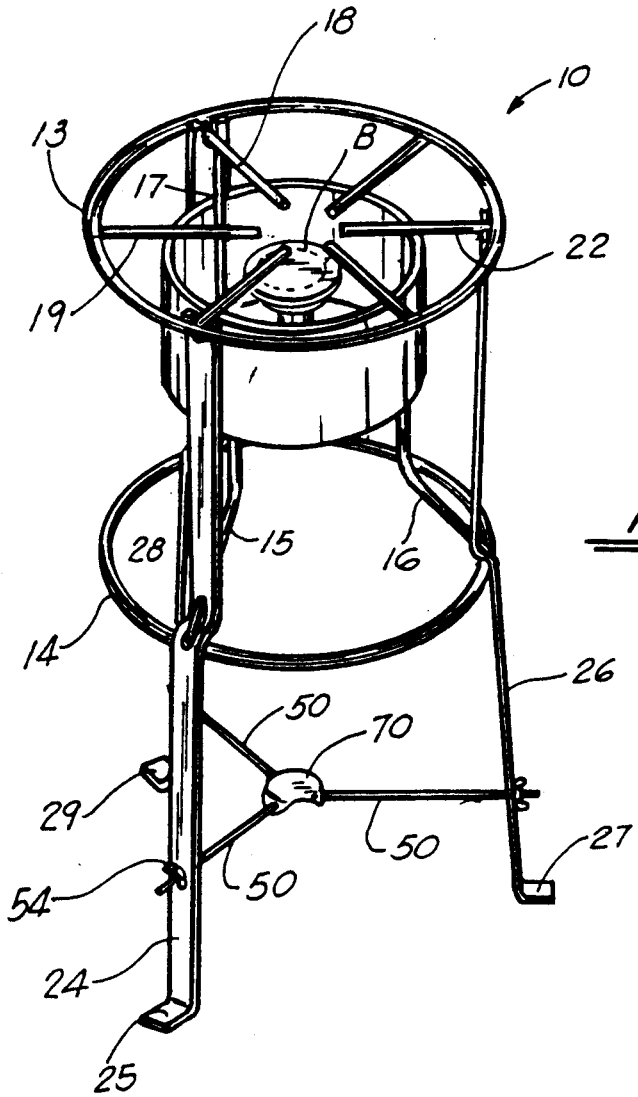
FIG. 1 is a perspective view of the preferred embodiment of the apparatus of the present invention.
Figure 2:
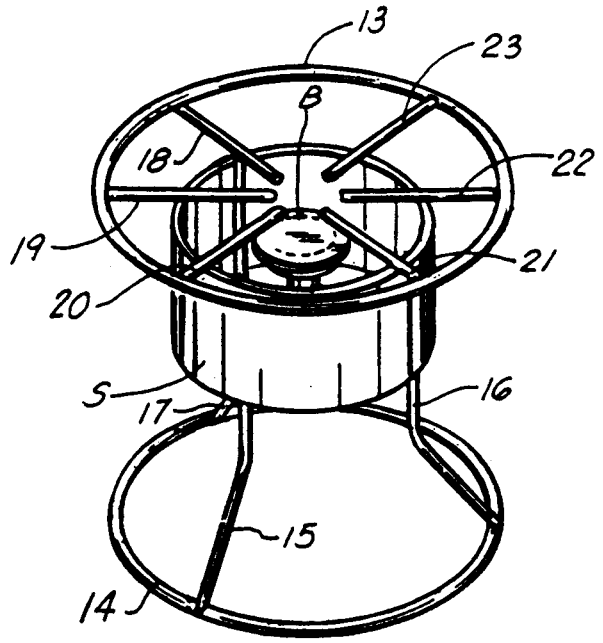
FIG. 2 is a perspective view of a primary burner frame as used with the apparatus of the present invention.
Figure 3:
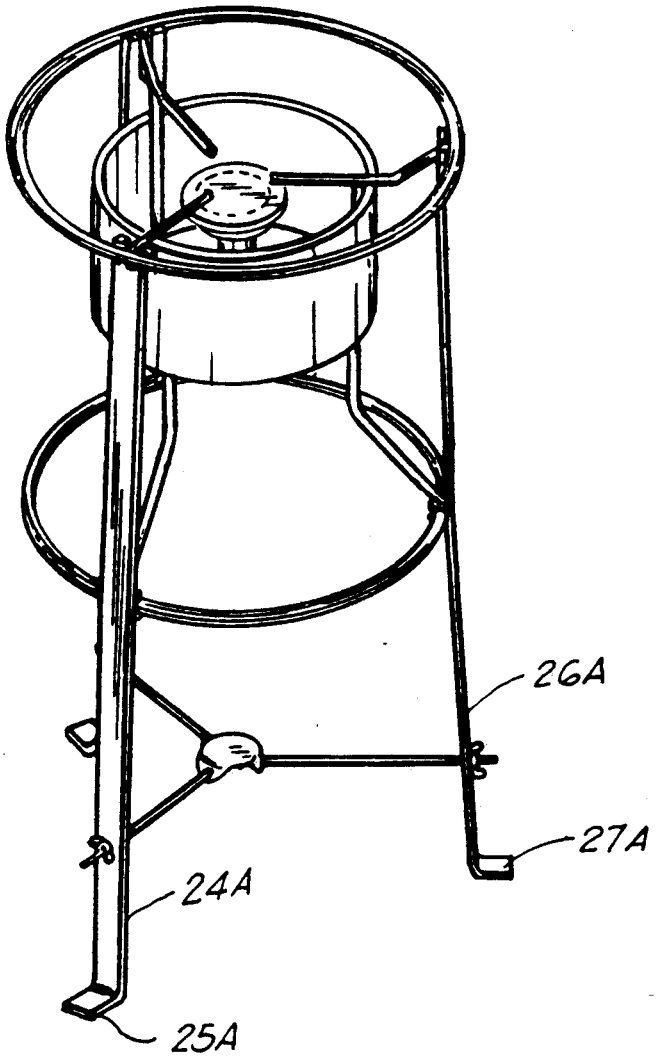
FIG. 3 is a perspective view of a second embodiment of the apparatus of the present invention.
Figure 4:
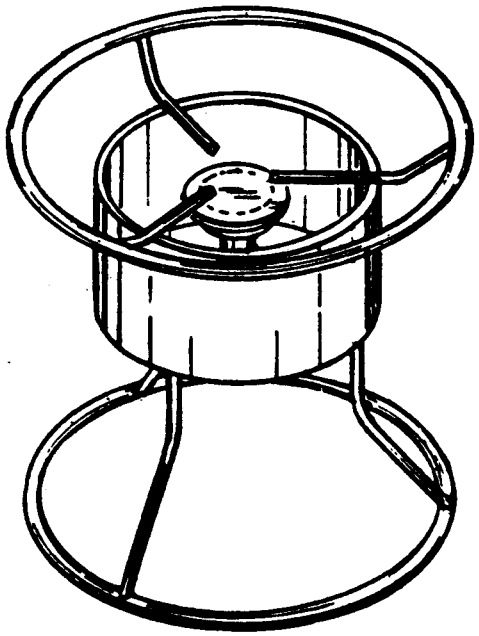
FIG. 4 is a perspective view of another primary burner frame as used with the apparatus of the present invention.

FIGS. 1 and 2 illustrate generally the preferred embodiment of the apparatus of the present invention designated generally by the numeral 10.

In FIG. 1, burner apparatus 10 includes a primary burner frame 12 that includes upper ring 13, lower ring 14 and a plurality of connecting struts 15, 16, 17. A plurality of radially extending grate members 18–23 extends inwardly from ring 13 and defines an upper most surface for carrying a large pot during use. The strut 15 extends upwardly from ring 14, forming a connection with grate member 20. The connection between strut 15 and lower ring 14 as well as the connection between 20 and the upper end of strut 15 are typically welded connections. Similarly, strut 16 extends upwardly from ring 15 and forms a connection with grate member 22 while strut 17 extends upwardly from ring 14 and forms a connection with grate member 18 each of the above referenced connections being typically being welded. Similarly, a welded connection can be used to attach each of the grate members 18–23 to upper ring 3. It should be understood that the primary burner frame of FIG. 2, which is a part of and used with the overall apparatus 10 of the present invention, is a commercially available, prior art burner frame.

A burner "B" which is commercially available is housed at the center of primary frame 12, supported by welding or bolting the burner "B" to shroud "S". Burner "B" is adapted to receive a source of gaseous fuel such as propane or butane via a high pressure regulator and LP hose which is known in the art. Canisters of propane, supply hoses and regulators are all commercially available accessories.

In the primary burner frame arrangement as shown in FIG. 2, the lower ring 14 functions as a very strong base which can be placed on concrete or other suitable underlying support so that the burner frame shown in FIG. 2 can support a very large pot. Indeed, a pot can be placed upon the plurality of grate members 18–23 and upper ring 13 wherein the diameter of the pot extends beyond the diameter of the upper ring 13. Thus, the primary burner frame of FIG. 2 can carry pots of a one hundred (100) quart volume as an example. Rings 13, 14 would be for example on the order of 12–15 inches in diameter with the lower ring 14 being the same diameter or slightly larger than the diameter of ring 13. In the preferred embodiment 10 of FIG. 1, a plurality of legs 24, 26, 28 are provided each having a lower most foot 25, 27, 29 so that the legs can be used to support primary burner frame 12 in an elevated position and wherein the lower feet 25, 27, 29 function as a base for abutting an underlying surface such as a concrete floor, patio, deck, or the like. The arrangement of FIG. 1 thus converts the primary burner 12 to an elevated burner which can function to support a smaller pot at an elevated position of about thirty inches (30") above the elevation of feet 25, 27, 29. The arrangement of FIG. 1 is typically used when frying foods wherein hot oil such as peanut oil is used.

In the configuration of FIG. 1, a pot used in frying is typically much smaller than the pot used when only the primary burner frame of FIG. 2 is in use. Thus, the pot used with the embodiment of FIG. 1 would be for example a nine to ten (9–10) quart aluminum deep fryer having a basket liner. This type of deep fryer and basket are commercially available and are typically used for frying food such as fish, shrimp, oysters, potatoes, chicken, soft shell crabs and the like.

The construction of legs 24, 26, 28 is shown more particularly in FIGS. 6–9 wherein leg 26 is shown. However, it should be understood that the construction of each leg 24, 26, 28 is identical to that shown in FIGS. 6, 7, 8 and 9 for leg 26. The leg 26 includes a lowermost foot 27 at its lower end portion. A stepped portion 30 of leg 26 includes a downwardly facing concave portion 31 and an upwardly facing concave portion 32 which are formed respectively by first bend 33 that communicates with a lower end 34 of leg 26 and a second bend 35 which communicates with the upper end 36 of leg 26.

Figure 5:
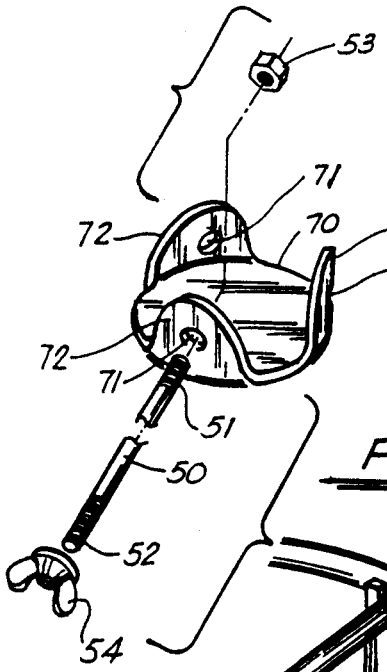
FIG. 5 is a fragmentary view illustrating the spoke and central hub portions of the preferred embodiment of the apparatus of the present invention.
Figure 6:
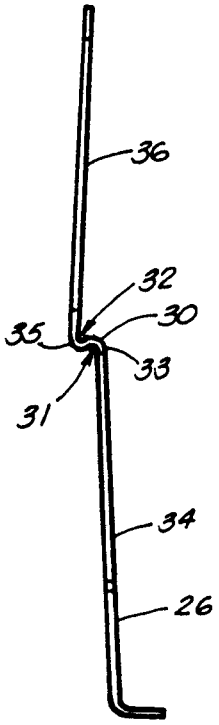
FIG. 6 is side fragmentary view illustrating one of the legs of the preferred embodiment of the apparatus of the present invention.

An opening 37 in lower end portion 34 of leg 26 accommodates linear spoke 50 which is preferably threaded at both ends. Spoke 50 attaches to central hub 70 (FIG. 5) at opening 71 in tab 72, preferably three tabs 72 and three openings 71 being provided, corresponding to the plurality of legs 24, 26, 28. Each spoke 50 thus provides threaded end portions 51, 52 and a bolt connection 53 (or alternatively wing nut 54) for affixing the threaded end portion 51 to hub 70 and the end portion 54 to leg 26.

Figure 7:
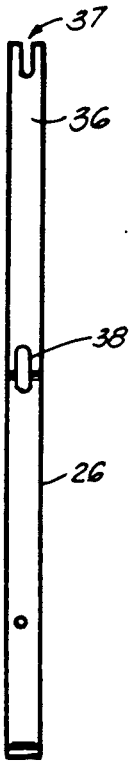
FIG. 7 is a front view of one of the legs used in the preferred embodiment of the apparatus of the present invention.
Figure 8:
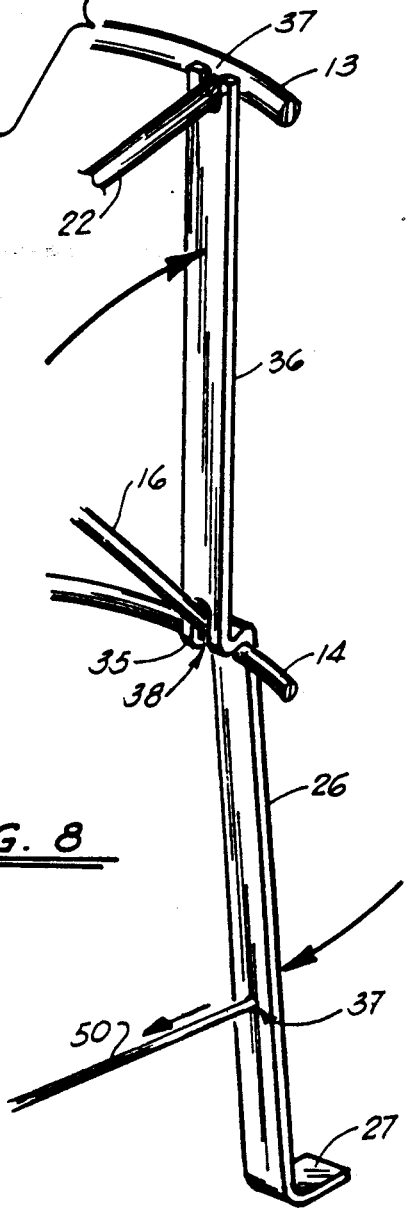
FIG. 8 is a fragmentary perspective view of the preferred embodiment of the apparatus of the present invention.
Figure 9:
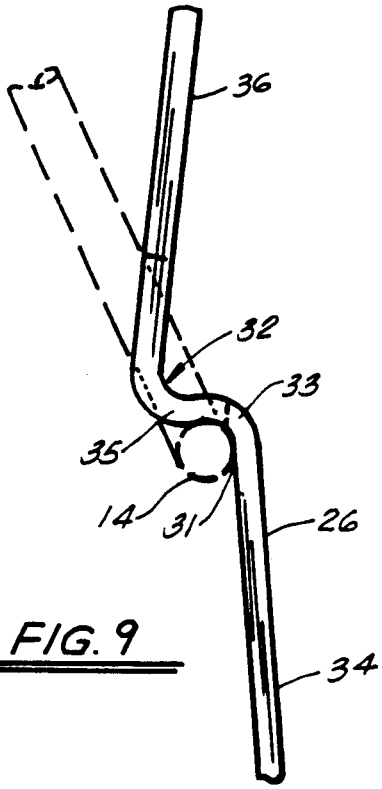
FIG. 9 is a fragmentary sectional view of the preferred embodiment of the apparatus of the present invention.
Figure 10:
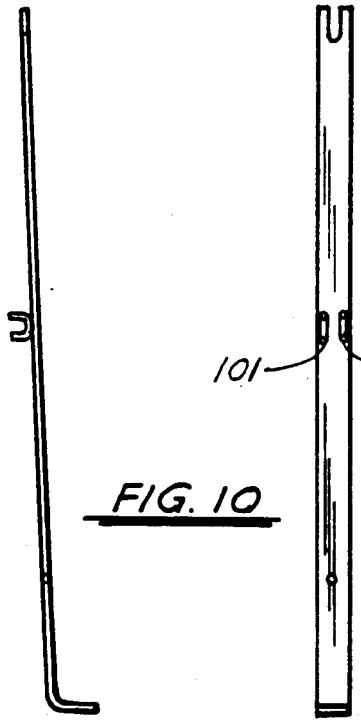
FIGS. 10 and 11 are side and front views of an alternate leg construction as used with the alternate embodiment of the apparatus of the present invention.
Figure 11:
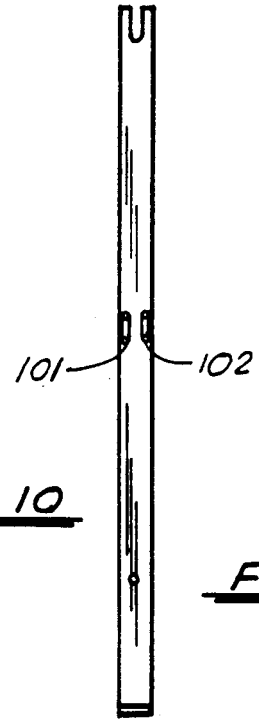

The curved portion 33 registers with and overlaps lower ring 14 of primary burner frame 12 during use. Leg 26 also provides a slot 38 that extends longitudinally along leg 26 at curved portion 35 as shown in FIGS. 7–8. Slot 38 accommodates vertical strut 16 of burner frame 12 as shown in FIG. 8, when lower ring 14 registers with bend 33 in the concave recess 31. Upper portion 36 of each leg 26 provides an upwardly facing U-shaped socket 37 that supports one of the grate members 18–23. In FIG. 8, grate member 22 registers in slot 37.

Upon assembly of the three legs 24, 26, 28 to primary burner frame 12 as before described, each of the legs is secured to hub 70 with a radially extending spoke 50. In this manner, lateral movement of the legs 24, 26, 28 away from hub 70 is prevented by the spokes 50, hub 70, and bolt or wing nuts 53, 54. Use of the bolt connections 53 and wing nuts 54 allow disassembly of the unit upon completion of cooking.

Figure 12:
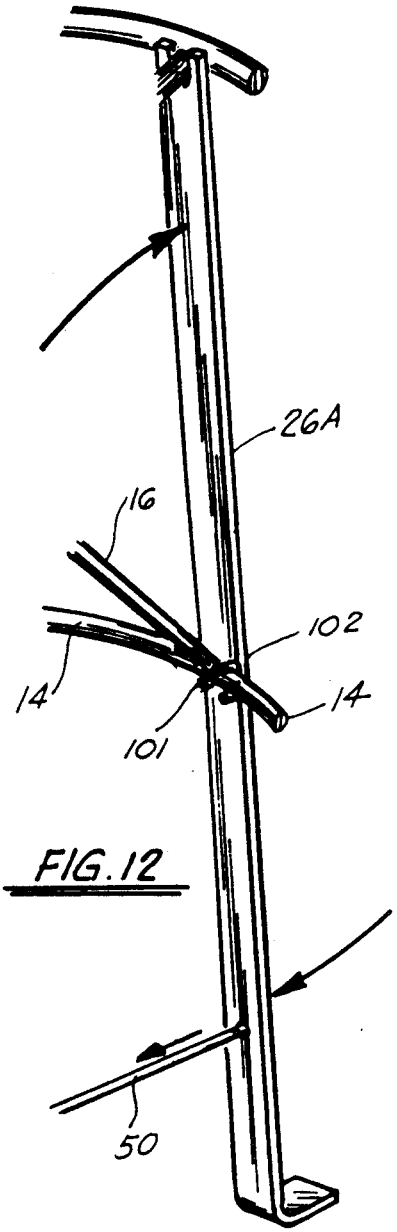
FIG. 12 is a fragmentary perspective view of the alternate embodiment of the apparatus of the present invention.
Figure 13:
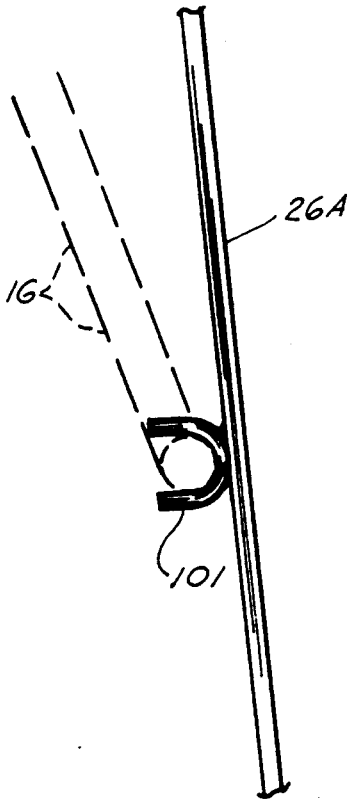
FIG. 13 is a sectional fragmentary view of the alternate embodiment of the apparatus of the present invention.

In the embodiment of FIGS. 3, 4 and 10–13, an alternate construction is provided, designated generally by the number 100. In the embodiment of FIGS. 3–4 and 10–13, the legs are designated by the numerals 24A, 26A, 28A and are each provided with a pair of C shaped bearing members 101, 102 which extend about the lower ring 14 as shown in FIGS. 12 and 13 and are positioned on each side of strut 16. Otherwise, each leg includes the same lowermost foot portions 25A, 27A, 29A as with regard to the preferred embodiment wherein the feet are labeled 25, 27, 29. Further, in the alternate embodiment uppermost slots 37A are provided which correspond with the slots 37 of the preferred embodiment.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A convertible burner apparatus comprising:

a) a primary burner frame that includes upper and lower generally parallel rings and a plurality of struts connecting the rings and supporting the upper ring a distance above the lower ring, the lower ring defining a base for bearing against a flat underlying surface during use;

b) a burner element having influent connection means for removably connecting a source of fuel gas to the burner element;

c) a plurality of radially spaced grate members positioned adjacent the upper ring for supporting a pot during use;

d) a plurality of elongated legs each substantially taller than the primary burner frame and removably connectable to the primary burner frame, for supporting the primary burner frame in an elevated position, and wherein the legs each include feet for bearing against a flat underlying surface during use;

e) connection means for removably affixing each leg to the primary burner frame at positions respectively adjacent the upper and lower rings and including an upper removable connection of the top portion of each leg to the upper portion of the burner frame, and a lower removable connection of the middle portion of the leg to the lower end portion of the burner frame; and f) means for preventing lateral movement of the legs at a position below the lower ring.

2. The apparatus of claim 1 further comprising a shroud having a diameter smaller than the diameter of the upper ring extending around the burner element.

3. The apparatus of claim 1 wherein the connection means includes an upper connector end portion of each leg that has an upwardly facing socket for receiving a portion of the upper ring of the primary burner frame.

4. The apparatus of claim 3 wherein the socket is generally U-shaped.

5. The apparatus of claim 3 wherein the legs have upper end portions and each socket is upwardly facing to receive the upper ring thereunto and wherein each socket has a bottom portion receptive of the upper ring which bears upon each leg at the bottom of its socket.

6. A convertible burner apparatus comprising:

a) a primary burner frame that includes upper and lower generally parallel rings and a plurality of struts connecting the rings and supporting the upper ring a distance above the lower ring, the lower ring defining a base for bearing against a flat underlying surface during use;

b) a burner element having influent connection means for removably connecting a source of fuel gas to the burner element;

c) a plurality of radially spaced grate members positioned adjacent the upper ring for supporting a pot during use;

d) a plurality of legs removably connectable to the primary burner frame for supporting the primary burner frame in an elevated position and wherein the legs each include feet for bearing against a flat underlying surface during use;

e) connection means for removably affixing each leg to the primary burner frame at positions respectively adjacent the upper ring and at the middle portion of the leg;

f) means for preventing lateral movement of the legs at a position below the lower ring; and g) wherein each leg has a bend at the middle portion thereof and each leg abuts the lower ring at the bend in the leg.

7. The apparatus of claim 1 further comprising a radially extending spoke connected to each leg at the lower end portion of the leg and a hub positioned inwardly of each leg and connected to each radially extending spoke.

8. The apparatus of claim 1 further comprising a nesting member adjacent the upper ring for laterally confining a pot and including grate members below the level of the upper ring.

9. The apparatus of claim 8 wherein the bend of each leg abuts the lower ring at an intersection between the lower ring and a strut of the primary burner.

* * * * *